United States Patent [19]

Rudnick et al.

[11] Patent Number: 5,062,526

[45] Date of Patent: Nov. 5, 1991

[54] JEWELRY DISPLAY DEVICE

[76] Inventors: Alan S. Rudnick; Lance N. Janke, both of Rte. 3, Plymouth, Wis. 53073

[21] Appl. No.: 452,213

[22] Filed: Dec. 18, 1989

[51] Int. Cl.[5] ..... B65D 6/04

[52] U.S. Cl. ..... 206/6.1; 206/486; 206/564; 206/566; 211/13

[58] Field of Search ..... 206/6.1, 44 R, 44.11, 206/45.14, 486, 490, 566, 562, 563, 564; 248/233, 176; 211/13

[56] References Cited

U.S. PATENT DOCUMENTS

| | | | |
|---|---|---|---|
| 720,389 | 2/1903 | Young | 206/564 |
| 1,305,241 | 5/1919 | Hendry | 206/566 |
| 1,373,299 | 3/1921 | Byrne | 211/13 |
| 2,099,906 | 11/1937 | Reese et al. | 211/13 |
| 2,119,832 | 6/1938 | Schless | 206/562 |
| 2,144,968 | 1/1939 | Gerth | 206/564 |
| 2,228,493 | 1/1941 | Will | 206/45.14 |
| 2,608,296 | 8/1952 | Masi, Jr. et al. | 206/564 |
| 2,618,382 | 11/1952 | Hunter | 206/564 |
| 2,861,682 | 11/1958 | Hatcher | 206/564 |
| 2,883,048 | 4/1959 | Lentz | 206/562 |
| 2,962,156 | 11/1960 | Adams | 206/564 |
| 3,197,166 | 7/1965 | Sandler | 206/565 |
| 3,431,041 | 3/1969 | Fontilladosa | 206/44.11 |
| 3,519,138 | 7/1970 | Murray | 211/13 |
| 3,660,873 | 5/1972 | Kawashima | 206/564 |
| 3,942,632 | 3/1976 | Witkoff | 206/44.11 |
| 4,193,198 | 3/1980 | Baller | 211/13 |
| 4,212,390 | 7/1980 | Raczkowski et al. | 211/13 |
| 4,300,674 | 11/1981 | Davet | 206/566 |
| 4,646,920 | 3/1987 | Kruger | 206/566 |
| 4,685,568 | 8/1987 | Elsfelder | 206/566 |
| 4,993,545 | 2/1991 | Feiler | 206/6.1 |

*Primary Examiner*—David T. Fidei

*Attorney, Agent, or Firm*—Andrus, Sceales, Starke & Sawall

[57] ABSTRACT

A display device for rings and similar items of jewelry includes a rigid unitary body having a wedge-shaped notch formed in the upper surface thereof, which notch is defined by an opposed pair of upwardly divergent surfaces between which rings having bands of varying width may be inserted and held for display purposes. The device may be formed in a wide variety of shapes and sizes, including embodiments having notches of different shapes and sizes formed in opposite sides to accommodate an even wider range of ring sizes. The display device may be formed from a variety of molding processes, preferably utilizing an acrylic resin or other clear plastic material, in either small individual ring sizes or elongated multi-ring displays.

1 Claim, 1 Drawing Sheet

FIG. 1
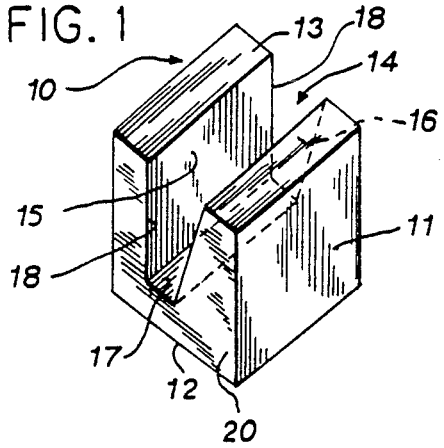
FIG. 2
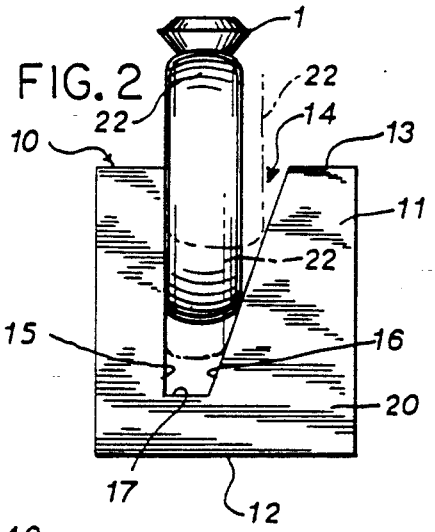
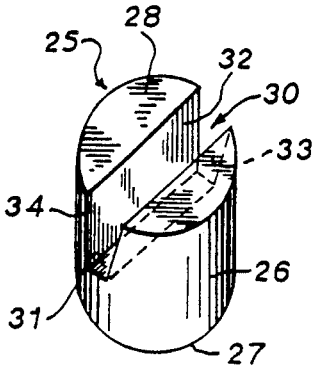
FIG. 3
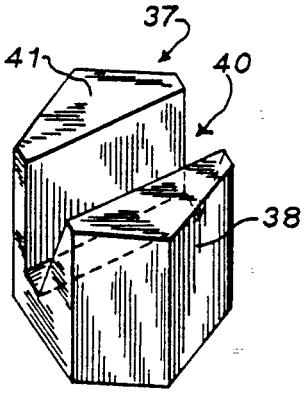
FIG. 4
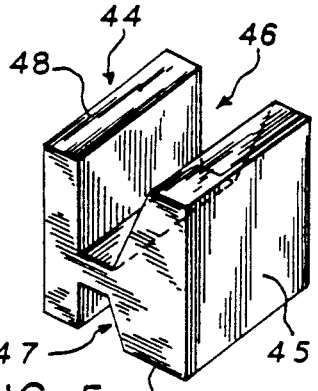
FIG. 5
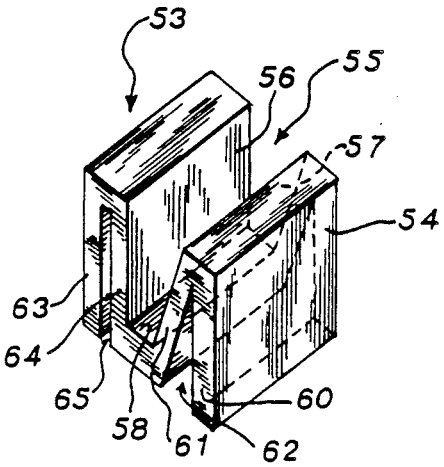
FIG. 6
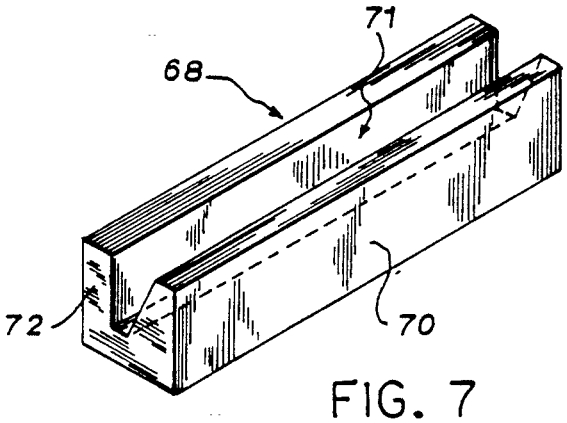
FIG. 7

JEWELRY DISPLAY DEVICE

BACKGROUND OF THE INVENTION

The present invention relates to a display device for jewelry and, more particularly, to a device for the single or multiple display of rings and similar jewelry items of varying sizes.

The prior art is replete with holders and other display devices for rings and similar items of jewelry. Such holders may be made to accommodate a single item or multiple items and should have some flexibility to accommodate variation in size of the various items of jewelry displayed therein. A typical prior art ring holder and display device is shown in U.S. Pat. No. 1,799,364 wherein a ring is inserted between a pair of curved and upwardly divergent flexible walls. The flexible walls are made of cardboard and covered with a suitable decorative fabric. The rings are simply slipped into the slot between the flexible walls and retained in place.

U.S. Pat. No. 354,799 shows a similar ring holder in which the curved, upwardly divergent opposing walls are made of a solid material, but are supported on a resilient backing such that they may deflect under the force of a ring inserted therebetween to clamp the same in position.

U.S. Pat. No. 720,389 discloses a split wooden block, the two pieces of which define a dove-tail slot which can be opened against the bias of a spring clamp and a ring inserted and held therein. Though providing a positive clamping, this device is somewhat awkward to manipulate and would appear to have a somewhat limited range of ring sizes which it could accommodate.

All of the foregoing patents substantially obscure the ring which is inserted and held in the holder which prevents the ring from being observed in its entirety without removing it from the holder. In addition, those prior art display and holder devices which include a fabric covering are subject to wear and soiling which detracts from their appearance and substantially shortens their useful life. U.S. Pat. No. 4,646,920 shows a display stand for rings or other items of jewelry which includes a clear plastic base with a flexible supporting member attached to the surface thereof and under which a ring or the like may be inserted and held in an upward display position. This device allows a virtually complete display of the ring, but has a rather complex construction and requires some dexterity and the use of two hands to mount a ring on it or to remove it therefrom.

It would be desirable to have a ring display device which is of simple construction, holds a ring or rings securely enough for normal display purposes, allows the ring to be easily and simply removed therefrom, and does not obscure the ring or other piece of jewelry displayed therein. In addition, the device should be durable, inexpensive, and adaptable to a wide range of display configurations.

SUMMARY OF THE INVENTION

In accordance with the present invention, a display for rings and the like includes a rigid unitary body, preferably made of a clear plastic material, and includes a flat supporting base portion and an upper surface portion, the latter having formed therein a wedge-shaped notch defined by a pair of opposed upwardly opening and divergent surfaces. A ring or similar item of jewelry may be placed with its band in the notch where it is received with a gentle wedging action which holds it in place adequately for display purposes. The wedge shape of the notch accommodates bands of varying width, all of which are similarly held therein. Virtually complete visibility of the ring is maintained in a display device which is durable, inexpensive, easy to manufacture, and adaptable to be made in a wide variety of sizes and shapes.

Preferably, the ring-receiving notch in the display device of the present invention utilizes upwardly divergent surfaces which are planar in configuration. Further, the divergent surfaces are preferably perpendicular to a common plane. The bottom of the wedge-shaped notch may be truncated by providing a lower interior surface which extends between the lower ends of the upwardly divergent surfaces.

The display device preferably has a flat horizontal upper surface in which the wedge-shaped notch is formed and the notch typically extends laterally through the entire body of the device such that it is open on its lateral ends. The body may have a generally rectangular shape, a cylindrical shape in the vertical direction, or a shape which in cross section is in the form of some other polygonal figure.

The body may also include a second wedge-shaped notch in the lower supporting surface which becomes functional when the display device is inverted, as to display a different size or shape of ring or the like. The display device may also be made in the form of an elongate bar in which the wedge-shaped notch extends along the full length of the bar. Such a construction lends itself well to manufacture by extrusion techniques. And a bar made of a clear acrylic plastic, for example, might be used as a multiple ring display device or cut into individual single ring display mounts.

BRIEF DESCRIPTION OF THE DRAWINGS

FIG. 1 is a perspective view of a preferred embodiment of the ring display device of the present invention.

FIG. 2 is an end elevation view of the ring display device shown in FIG. 1 and additionally showing the manner in which the wedge-shaped notch accommodates rings of varying sizes.

FIG. 3 is an alternate embodiment of the display device of the present invention.

FIG. 4 shows another embodiment of the ring display device of the present invention.

FIG. 5 is a perspective view of an embodiment of the invention having separate ring-receiving notches in opposite surfaces thereof.

FIG. 6 is a perspective view of a further embodiment of the invention.

FIG. 7 is a perspective view of another ring display device incorporating the present invention, but made in an elongated bar shape for multiple ring display.

DETAILED DESCRIPTION OF THE PREFERRED EMBODIMENT

Referring first to FIGS. and 1 and 2, a ring display device 10 is made of a piece of solid material, such as a clear acrylic plastic, and includes a rigid unitary body 11 which has a flat lower supporting base portion 12 and an upper surface portion 13. Overall, the body is substantially cube-shaped, but as will be described hereinafter, the outer body portion may be made in a variety of shapes.

A wedge-shaped notch 14 is formed in the upper surface portion 13 and extends downwardly into the body 11. The notch 14 is defined by a pair of opposed, upwardly divergent surfaces 15 and 16. The notch 14 is preferably truncated by providing a lower interior surface 17 which is generally horizontally disposed and extends between the lower edges of divergent surfaces 15 and 16.

The notch 14 extends completely through the body 11 to define opposite open ends 18. One divergent surface 15 is disposed substantially vertically and perpendicular to the base 12 and upper surface portion 13. The other divergent surface 16 is disposed at an acute angle to the vertical to provide the upwardly divergent orientation between the surfaces 15 and 16.

In the preferred embodiment, divergent surfaces 15 and 16 are planar and perpendicular to a common plane, such as the plane of the end face 20 of the body 11 in the generally cubic configuration shown in FIGS. 1 and 2.

As is best shown in FIG. 2, the vertically varying width of the wedge-shaped notch 14 as a result of the upwardly divergent surfaces 15 and 16, will accommodate the receipt of a variety of sizes of rings 21 having bands 22 of varying width. The ring 21 is simply placed with the underside of the band extending downwardly into the notch 14 until it is wedged slightly between the divergent surfaces 15 and 16 where it is held in a display position. The ring 21 may be disposed in the notch in a generally vertical position as shown or may be tilted slightly through the angle defined by the surfaces 15 and 16 to rest at an acute angle with respect to the vertical. The lower interior surface 17 of the notch provides a convenient termination point for the notch and also eliminates the formation of a sharp V-shaped notch which would undesirably extend the depth of the notch beyond that reasonably required and also provide a point for the unsightly accumulation of dust, dirt and the like.

As an example of one size of display device 10 which would accommodate a fairly substantial range of ring band widths, the body 11 may be formed from a cube of clear acrylic plastic having $\frac{7}{8}$" sides. The notch may be formed with a vertical depth of about $\frac{5}{8}$" and the width across the notch varying from a width of the lower interior surface 17 of about 3/32" to an opening in the upper surface portion 13 approximately 5/16" wide. In this configuration, the acute angle of the angled divergent surface 16 with respect to the vertical is in the range of about 7° to 8°. Obviously, however, the foregoing dimensions could be varied considerably, including the overall size of the body 11, the depth of the notch 14, the width of the lower interior surface 17, and the angle at which the surface 16 diverges from opposed surface 15.

FIG. 3 shows another display device 25 having a cylindrical body 26, the axis of which is vertically disposed. The display device 25 has a flat supporting base 27 on its underside and a flat parallel upper surface 28. A wedge-shaped notch 30 is provided in the cylindrical body 26 extending downwardly from the upper surface 28 and terminating in a lower interior surface 31. The notch 30 may be of generally the same size and shape as the notch 14 of the embodiment of FIGS. 1 and 2. Thus, it may include a pair of opposed upwardly divergent surfaces 32 and 33. The notch 30 extends generally diametrically through the cylindrical body 26 and has opposite open ends 34.

In FIG. 4, there is shown another embodiment of a display device 37 having a body 38 which is hexagonal-shaped in horizontal cross section. A ring-receiving notch 40 having a wedge-shape as in the previous embodiments is formed or cut in the body 38 and extends downwardly from the flat horizontal upper surface 41 thereof. In all other respects, the notch 40 may be identical or similar to the notches 14 and 30 of the previously described embodiments.

FIG. 5 shows yet another embodiment of a display device 44 which has a generally rectangular body 45 similar to that of the FIG. 1 embodiment, but having a pair of upper and lower notches 46 and 47, respectively, formed therein. The upper notch 46 extends downwardly into the body 45 from its open end in the upper surface 48 and, conversely, the lower notch 47 extends upwardly into the body 45 from its opening in the lower surface 50. The notches 46 and 47 may be similar to those described with respect to the preceding embodiments, but are preferably somewhat different from one another in size and/or shape such that the display device 44 may be conveniently inverted to rest on its upper surface 48, whereby the lower notch 47 is upwardly disposed for receipt of a ring which may not be accommodated as well in the upper notch 46.

The display device 53 shown in FIG. 6 includes a body 54 having a substantially more open construction than the embodiments of FIGS. 1–5. As may be seen, the body 54 is generally M-shaped in vertical cross section through the wedge-shaped notch 55. The notch 55 is of a shape generally the same as those in the previously described embodiments and, therefore, includes a pair of opposed upwardly divergent surfaces 56 and 57 and a lower internal surface 58 connecting the lower edges of divergent surfaces 56 and 57. One surface 56 is vertically disposed and the other surface 57 lies at an acute angle with respect to the vertical, all as previously described with respect to the display devices 10, 25, 37 and 44. The M-shaped body 54 includes a front leg 60 which, with an interior leg 61 forming the angled divergent surface 57, define between them a downwardly opening wedge-shaped notch 62. However, downwardly opening notch 62 is substantially narrower than the primary upwardly opening notch 55 and may be utilized in a manner similar to the lower notch 47 of the FIG. 5 embodiment to accommodate a range of sizes of rings having bands narrower than those which would be accommodated by the upper notch 55. Of course, the display device 53 is inverted to utilize the lower downwardly opening notch 62. The rear leg 63 of the display device is disposed to define, with the adjacent interior leg 64, a narrow, generally rectangular slot 65.

Each of the notches 55 and 62 and the rectangular slot 65 extends laterally through the body 54 to define open opposite ends, in the same manner as each of the previously described embodiments. The rectangular slot 65 may be substantially non-functional with respect to the utility of the device to hold and display a ring. However, the M-shaped cross section lends the structure well to formation by extrusion.

FIG. 7 shows a display device 68 in accordance with a further embodiment of the invention which is particularly adapted to hold and display a plurality of rings. The device includes an elongated body 70 having a ring-receiving notch 71 which extends the full length of the body, but is otherwise substantially identical to the notch 14 of FIG. 1. The display device 68 may be formed by extrusion to any desired length and utilized, as shown, for the display of a plurality of rings, or may be subsequently cut into shorter pieces on planes parallel to the end face 72. Obviously, the embodiments of FIGS. 5 and 6 could also be formed by, extrusion into long bars and utilized in that shape or similarly cut into shorter sections.

When formed from a clear or tinted acrylic resin, by injection molding, extrusion, or some other molding process, the ring display devices of each of the disclosed embodiments provide a simple, convenient, inexpensive yet very functional means for mounting and displaying rings or other similar items of jewelry. The wedge-shaped notch of each embodiment accommodates a variety of ring band widths and the transparent plastic and open notch configuration allow the entire piece of jewelry to be viewed without removing it from the display device. Nevertheless, the ring or other item of jewelry may be easily removed and subsequently returned where it is held securely enough for conventional display purposes. By utilizing an acrylic resin or other clear plastic material, reflected and refracted light helps to enhance the attractiveness of the display.

Various modes of carrying out the present invention are contemplated as being within the scope of the following claims particularly pointing out and distinctly claiming the subject matter which is regarded as the invention.

We claim:

1. A display device for rings comprising:

a rigid unitary body having a lower supporting base portion and an upper surface portion;

a wedge-shaped notch in said body, said notch having an open upper end in said upper surface portion;

said notch being defined by a pair of opposed upwardly divergent planar surfaces, which surfaces are perpendicular to a common plane; and, a second wedge-shaped notch in said body, said second notch having an open lower end in said base portion;

whereby rings of varying band widths may be inserted and held between said divergent surfaces by a wedging action.

* * * * *